United States Patent [19]

Otrhalek et al.

[11] 3,954,645

[45] May 4, 1976

[54] ADDITIVE FOR AN ACID CLEANING BATH FOR METAL SURFACES

[75] Inventors: Joseph V. Otrhalek, Dearborn; Raymond M. Ajluni, Bloomfield, both of Mich.

[73] Assignee: BASF Wyandotte Corporation, Wyandotte, Mich.

[22] Filed: July 25, 1973

[21] Appl. No.: 382,537

Related U.S. Application Data

[63] Continuation-in-part of Ser. No. 197,948, Nov. 11, 1971, abandoned.

[52] U.S. Cl. ..... 252/101; 134/3; 252/79.1

[51] Int. Cl.[2] ..... C09K 13/00

[58] Field of Search ..... 252/100, 101, 79.2, 252/79.3, 80; 156/22, 23; 134/3

[56] References Cited

UNITED STATES PATENTS 2,975,039 3/1961 Elliott ..... 252/156

3,275,562 11/1963 Smith ..... 252/147

OTHER PUBLICATIONS

Rose, The Condensed Chemical Dictionary 6th Ed., 1961, p. 1047.

Lange's Handbook of Chemistry, p. 203, 1939.

*Primary Examiner*—Samuel W. Engle
*Assistant Examiner*—Ralph Palo
*Attorney, Agent, or Firm*—Norbert M. Lisicki; Bernhard R. Swick; Robert E. Dunn

[57] ABSTRACT

A method for the preparation of a liquid concentrate solution containing 10 to 60 percent by weight water from which a metal cleaning solution may be prepared by dilution with additional water.

The liquid concentrate was prepared from ferrous sulfate, an oxidant, an acid, a fluoride ion source and water. It may optionally contain ammonia and urea.

3 Claims, No Drawings

ADDITIVE FOR AN ACID CLEANING BATH FOR METAL SURFACES

This application is a continuation-in-part of copending U.S. patent application Ser. No. 197,948, filed Nov. 11, 1971, now abandoned.

BACKGROUND OF THE INVENTION

1. Field of the Invention

The present invention pertains to a method for the preparation of a liquid concentrate from which a metal cleaning solution may be prepared by dilution with additional water. More particularly, the present invention pertains to the method of preparing a liquid concentrate from which a dilute metal cleaning solution may be obtained which is suitable for the removal of smut, oxide films, conversion coatings, tarnish and scale from aluminum, brass and copper. Even more particularly, the present invention concerns the preparation of non-chromated baths and additives therefor useful for cleaning metal surfaces.

2. Prior Art

The post-cleaning of metal surfaces after caustic etching or oxidation has most often involved treating the metal surface with an acidic solution of nitric acid, sulfuric acid, hydrofluoric acid, mixtures thereof and the like.

To remove oxide films, conversion coatings and the like from metal surfaces, mixed acid pickling baths containing chromic acid are most conventionally employed.

For a general discussion of acid cleaning baths, see Murphy, J. A., *Surface Preparation and Finishes for Metals*, 1st Ed., McGraw-Hill Book Company, New York, N.Y., (1971) at pp. 46–57.

Chromic acid baths inherently create waste disposal problems thereby somewhat negating their utility. The other acid baths have rather limited application since they can only remove smut from caustic etching and the like.

Accordingly, in the prior art, cleaning compositions employing ferric sulfate have been developed to overcome these problems. These compositions, however, were prepared only as a dry concentrate or as the ultimate dilute cleaning solution.

Subsequent to the development of such compositions it became desirable to prepare a liquid concentrate containing from 10 to 60 percent by weight of water for marketing purposes. However, attempts to prepare such concentrates by simply dissolving the dry ferric sulfate compositions in water failed since these compositions would not dissolve completely in such small amounts of water.

SUMMARY OF THE INVENTION

It has surprisingly been discovered in accordance with this invention that by preparing such composition from ferrous sulfate, then oxidizing the ferrous ion to ferric, a liquid concentrate containing from 10 to 60 percent by weight water could be obtained. This results in a liquid concentrate which is a most desirable way for marketing such a product.

In accordance with the present invention, a concentrated liquid solution containing 10 to 60 percent by weight water from which a metal cleaning solution may be prepared by dilution with additional water is prepared by mixing a. ferrous sulfate,
b. oxidant selected from the group consisting of hydrogen peroxide and nitric acid,
c. sulfuric acid,
d. fluoride ion source, and
e. water.

Optionally, minor amounts of ammonia and urea can be incorporated into the concentrate or ultimate use composition.

Further cleaning improvement may be obtained by the addition of ammonia and a nitrite ion source.

For a more comprehensive discussion of the utility of the present invention, reference is made to the following detailed description and examples thereof.

DESCRIPTION OF THE PREFERRED EMBODIMENT

The method of preparing the concentrate consists essentially of mixing the various components in a stainless steel jacketed vessel, with water cooling, by the following steps:

a. adding water to the vessel;
b. while cooling and agitating the contents of the vessel, adding ammonia (when desired), nitric acid and/or hydrogen peroxide and sulfuric acid slowly to avoid spattering;
c. adding the fluoride ion source;
d. after cooling the vessel contents to 100° to 120° F., adding one part of urea (when desired) and slowly sifting in ferrous sulfate at such a rate that gassing is not so excessive as to generate nitrous oxide fumes; and
e. continuing the addition of urea (when desired) and ferrous sulfate alternately until the required amount has been added.

The resulting solution will be a clear homogeneous dark amber liquid.

In general, the percentages by weight of the materials mixed to form the concentrate are from about:

a. 1 to 50 percent of ferrous sulfate;
b. from about 5 to 25 percent of oxidant;
c. from about 5 to 60 percent of sulfuric acid;
d. from about 0.2 to 5 percent fluoride ion source;
e. from about 0 to 8 percent ammonia;
f. from about 0 to 5 percent urea; and
g. from about 10 to 60 percent of water.

Preferably, the percentages by weight of these materials are:

a. from about 5.0 to 30 percent of ferrous sulfate;
b. from about 10 to 25 percent of oxidant;
c. from about 10 to 50 percent of sulfuric acid;
d. from about 0.5 to 3 percent of fluoride ion source;
e. from about 1 to 4 percent ammonia;
f. from about 1 to 4 percent urea; and
g. from about 15 to 50 percent water.

Each ingredient of the bath, by itself, or in admixture with any of the other ingredients, less than the total composition is ineffective in producing the desired result. Thus, in essence, the present bath is a synergistic blend of ingredients and each is dependent on the other for its utility here. The ferrous sulfate is oxidized by the oxidant to the ferric state and is a strong oxidant in an acid medium. The acid acidulates the entire mixture to render it useful as a cleaner. The fluoride ion source, when in an acid medium, dissociates to form hydrogen fluoride.

The fluoride ion source as contemplated herein can be derived from any suitable salt capable of dissociating in an acid into a cation and anion without otherwise affecting the system. Suitable sources include, for example, sodium fluoride, sodium bifluoride, potassium fluoride, potassium bifluoride, ammonium fluoride, ammonium bifluoride, silica fluoride, and the like. Preferred sources include sodium bifluoride, potassium bifluoride, ammonium bifluoride and, in particular, ammonium bifluoride.

It should be noted that where nitric acid is employed as the oxidant, toxic nitrous oxide fumes are emitted. However, inclusion of from about 0.1 to 5 percent by weight of the concentrate of urea obviates this situation since the urea will react with nitrous oxide to form nitrogen gas and carbon dioxide.

As noted hereinbefore, ammonia can optionally be incorporated with the bath. The ammonia, as more fully discussed below, inhibits and prevents plating in solution and is generally employed in an amount of from 0 to 8 percent by weight, based on the weight of the bath.

The ferrous sulfate contemplated herein may be one of the following: ferrous sulfate anhydrous, ferrous sulfate monohydrate, ferrous sulfate pentahydrate and ferrous sulfate heptahydrate. The preferred source is the ferrous sulfate heptahydrate.

The bath or concentrate prepared by the method of this invention is conventionally employed as an aqueous use solution thereof consisting essentially of:

a. from about 0 to 99 percent by weight of water and
b. from about 100 to 1 percent by weight of the concentrate.

Preferably, the use solution consists essentially of:

a. from about 80 to 95 percent by weight of water and
b. from about 20 to 5 percent by weight of the concentrate.

It should be noted that, in preparing the use solution itself, no special procedural steps are necessary other than those conventionally employed when mixing water with acid.

The above use solution is particularly adapted for the cleaning of metal surfaces and is effective in removing etching smut, oxide films, conversion coatings, anodizing tarnish, scale and the like therefrom. The present bath is useful for cleaning of aluminum, brass, copper and alloys thereof and analogous metals.

When treating most metal surfaces with the abovedefined use solution, a temperature of about 20° to 70°C. is normally employed and the immersion time will vary depending on the condition of the surface. Generally, no longer than about 10 to 25 minutes will be required to clean the surface regardless of the nature of the surface, i.e., whether it is smutted, has an oxide film, a conversion coating, anodized, or the like. Usually, an immersion time of 3 to 5 minutes will suffice to effectively clean the surface.

In accordance with another aspect of the present invention, there is provided an accelerator additive for use with the above-defined acid bath. The incorporation of the additive into the bath reduces the time necessary to clean metal surfaces by upwards of about 80 percent or more. Specifically, it has been found, in accordance herewith, that the addition of a nitrite ion to the acid bath greatly promotes the effectiveness of the acid bath thereby reducing the immersion time therein for a metal surface to be cleaned and, as such, the nitrite ion constitutes the essence of the additive.

Also, it has been found that the nitrite ion must be incorporated into the bath as an additive in order for it to be effective. If the nitrite ion is utilized as an ingredient in the acid bath, per se, it is decomposed to nitrous oxide gases, thereby rendering it ineffectual. Thus, the nitrite ion is introduced as an additive thereof. This additive generally consists essentially of:

a. a nitrite ion source;
b. ammonia; and
c. water.

Useful sources of nitrite ions can be derived from a multitude of compounds including, for example, potassium nitrite, sodium nitrite, ammonium nitrite, and the like, as well as mixtures thereof. The preferred nitrite ion source is sodium nitrite.

The effectiveness of the nitrite ion is thought to be attributable to its combined effect as an oxidant with the ferric ion from the oxidized ferrous sulfate.

In order to increase the tolerance of the bath for dissolved copper and to retard plating on the aluminum surfaces, ammonia is also included in the additive. The ammonia can be deleted from the additive if utilized in the original bath. The additive is prepared as an aqueous solution thereof to render it more readily compatible with the concentrate and use solution.

Generally, the additive will consist of:

a. from about 25 to 35 percent by weight of nitrite ion source;
b. from about 0.0 to 5.0 percent by weight of ammonia; and
c. from about 65 to 75 percent by weight of water.

Preferably, the additive consists essentially of:

a. from about 30 to 32 percent by weight of nitrite ion source;
b. from about 1 to 2 percent by weight of ammonia; and
c. from about 68 to 70 percent by weight of water.

The additive is utilized in the acid bath use solution in an amount ranging from about 1 to 4 percent by weight thereof, based on the weight of the bath, and preferably from about 2 to 4 percent by weight of additive, based on the weight of the bath.

It should also be noted that the above-defined additive is also useful in prior art metal cleaning acid baths.

For a more complete understanding of the present invention, reference is made to the following examples which illustrate various, non-limiting embodiments thereof. In the examples all parts are by weight absent indications to the contrary.

EXAMPLE I

A series of aluminum alloy panels were etched at 160° F. for 6 minutes using a conventional caustic soda etching bath. After etching, each of the panels were immersed in an aqueous use solution of acid bath and accelerator in accordance with the present invention for a period of about 10 minutes to desmut the etched surfaces.

The acid bath employed herein consisted essentially of:

| Ingredient | Amount, pbw |
|---|---|
| Ferrous Sulfate Heptahydrate | 25.0 |
| Hydrogen Peroxide (35%) | 8.0 |
| Sulfuric Acid (96%) | 25.0 |
| Ammonium Bifluoride | 1.3 |
| Water | 40.7 |

-continued

| Ingredient | Amount, pbw |
|---|---|
| | 100.0 |

The accelerator consisted essentially of:

| Ingredient | Amount, pbw |
|---|---|
| Aqueous Ammonia (26° Be) | 2.0 |
| Sodium Nitrite | 30.0 |
| Water | 68.0 |
| | 100.0 |

The results of the desmutting tests are set forth below in Table I.

Table I

| Use Soln. | % Acid Bath, Vol. | % Vol. Accel. | pH at 77° F. | % Smut Removal Aluminum Alloy 2024 | 6061 | 7075 |
|---|---|---|---|---|---|---|
| 1 | 8 | 0 | 0.72 | 0 | 70 | 90 |
| 2 | 7 | 1 | 0.85 | 100 | 100 | 100 |
| 3 | 4 | 1 | 1.10 | 95 | 100 | 80 |
| 4 | 2 | 0.5 | 1.32 | 70 | 90 | 50 |
| 5 | 8 | 1 | 0.80 | 95 | 100 | 100 |
| 6 | 8 | 2 | 0.85 | 100 | 100 | 100 |
| 7 | 8 | 3 | 0.90 | 100 | 100 | 100 |
| 8 | 8 | 4 | 0.99 | 100 | 100 | 100 |
| 9 | 12 | 3 | 0.65 | 100 | 100 | 100 |
| 10 | 16 | 0 | 0.40 | 60 | 60 | 80 |

It can be seen from the above that with varying aluminum alloys, nearly always, 100 percent smut removal is effectuated by the acid bath and accelerator.

EXAMPLE II

An acid bath in accordance with the present invention was prepared from the following:

| Ingredient | Amount, pbw |
|---|---|
| Ferrous Sulfate Heptahydrate | 35.0 |
| Nitric Acid (42° Be) | 16.0 |
| Sulfuric Acid (66° Be) | 16.0 |
| Ammonium Bifluoride | 1.0 |
| Urea (crystals) | 3.5 |
| Aqueous Ammonia (26° Be) | 3.0 |
| Water | 25.5 |
| | 100.0 |

The above bath was then tested as a smut remover in aqueous solution, alone, and with the accelerator of Example I on aluminum alloy test panels which were previously etched as described in Example I.

The results of these tests were as follows:

A. 10 percent by volume aqueous solution of acid bath

| Aluminum Alloy | Time, in Min., for 100% Smut Removal |
|---|---|
| 2024 | 15.0 |
| 6061 | 4.0 |
| 7075 | 10.0 |

B. 15 percent by volume aqueous solution

| Aluminum Alloy | Time, in Min., for 100% Smut Removal |
|---|---|
| 2024 | 10.0 |
| 6061 | 3.0 |
| 7075 | 5.0 |

C. 20 percent by volume aqueous solution

| Aluminum Alloy | Time, in Min., for 100% Smut Removal |
|---|---|
| 2024 | 5.0 |
| 6061 | 2.0 |
| 7075 | 2.5 |

D. 8 percent by volume aqueous solution and 1 percent of accelerator

| Aluminum Alloy | Time, in Min., for 100% Smut Removal |
|---|---|
| 2024 | 2.0 |
| 6061 | 2.0 |
| 7075 | 2.0 |

EXAMPLE III

The acid bath of Example II was tested as a tarnish and scale remover for brass and copper panels. The solution concentration was percent by volume aqueous solution of the acid bath of Example II. The temperature employed was room temperature.

The results of these tests were as follows:

A. Brass

| Solution Concentration | Time, in Minutes | % Tarnish Removal |
|---|---|---|
| 10% Volume | 5.0 | 50 |
| 15% Volume | 5.0 | 75 |
| 20% Volume | 5.0 | 100 |

B. Copper

| Solution Concentration | Time, in Minutes | % Tarnish Removal |
|---|---|---|
| 10% Volume | 5.0 | 75 |
| 15% Volume | 5.0 | 100 |

EXAMPLE IV

This example illustrates the utility of the accelerator in both the present and prior art cleaning systems and further provides more comparative data between the prior art and the present invention.

A series of 1 × 3 inches aluminum alloy test panels were etched as hereinbefore described leaving a heavy smut residue on the surfaces thereof.

Each of the panels were then immersed in various 50 ml. acid cleaning use solutions maintained at 70° F. for either a substantial period of time or until 100 percent smut removal was observed.

The aqueous use solutions employed were as follows:

A. 20 percent $HNO_3$ (70 percent conc.)

B. 20 percent $HNO_3$ (70 percent conc.) + 2 percent accelerator of Example I

C. 20 percent $HNO_3$ (70 percent conc.) + 4 percent accelerator of Example I

D. 8 percent of acid Bath of Ex. I + 2 percent $HNO_3$ (conc.)

E. 8 percent of acid Bath of Ex. I + 4 percent $HNO_3$ (conc.)

F. 8 percent of acid bath of Ex. I + 10 percent $HNO_3$ (conc.)

G. 8 percent of acid bath of Ex. I + 4 percent accelerator of Example I.

The results of these tests were as follows:

| Use Solution | Time, in Seconds, Required to Desmut Alloys | | |
|---|---|---|---|
| | 2024 | 6061 | 7075 |
| A | 180 | 720 | 360 |
| B | 25 | 660 | 390 |
| C | 15 | 660 | 360 |
| D | 360 (50% Removal) | 480 | 720 (part removal) |
| E | 480 | 255 | 720 (part removal) |
| F | 360 | 285 | 420 |
| G | 60 | 180 | 180 |

As can be seen from the above data, the accelerator greatly enhances the desmutting time for nitric acid cleaning baths as well as being much more efficacious than nitric acid when used conjointly with the present acid bath.

EXAMPLE V

This example shows the utility of the present invention with a multitude of aluminum alloys.

A series of 1 × 3 inch aluminum alloy test panels were etched as hereinbefore described using a conventional caustic soda-sodium gluconate etchant for 6 minutes at about 160° F.

The smutted surfaces were rinsed in cold water and then immersed in an aqueous solution of acid bath and accelerator maintained at about 77° F. until 100 percent smut removal was effectuated.

The use solution employed herein was either (a) an aqueous solution containing 8 percent by volume of acid bath of Example I and 2 percent by volume of accelerator of Example I or (b) an aqueous solution containing 8 percent by volume of acid bath of Example I and 4 percent by volume of accelerator of Example I.

The results of these tests were as follows:

| Aluminum Alloy | Use Solution | Time for 100% Smut Removal |
|---|---|---|
| 2024 | (a) | 2 to 3 minutes |
| | (b) | 1 minute |
| 1100 | (a) | 1 minute |
| | (b) | 1 minute |
| 5052 | (a) | 1 minute |
| | (b) | 1 minute |
| 6061 | (a) | 3 to 4 minutes |
| | (b) | 3 minutes |
| 6262 | (a) | 3 to 4 minutes |
| 7075 | (a) | 3 minutes |
| | (b) | 3 minutes |
| 7178 | (a) | 1 minute |
| | (b) | 1 minute |
| KB45 | (a) | 1 minute |
| | (b) | 1 minute |

It can be seen from the above that the present invention evidences excellent smut removal times with all aluminum alloys.

The embodiments of the invention in which an exclusive property or privilege is claimed are defined as follows:

1. The method of cleaning metal surfaces in an acid bath wherein from about 1 to 4 percent by weight, based on the weight of the bath, of an additive is incorporated into said bath, said additive consisting essentially of:

a. from about 25 to 35 percent by weight of a nitrite ion source;

b. from about 0 to 5 percent by weight of ammonia; and c. from about 65 to 75 percent by weight of water.

2. The method of claim 1 wherein the nitrite ion source is selected from the group consisting of sodium nitrite, potassium nitrite and ammonium nitrite.

3. The method of claim 2 wherein the nitrite ion source is sodium nitrite.

* * * * *